United States Patent [19]

Watts

[11] 4,418,835

[45] Dec. 6, 1983

[54] TRASH CONTAINER APPARATUS

[76] Inventor: Abner W. Watts, 7231 W. Bayaud Pl., Lakewood, Colo. 80226

[21] Appl. No.: 437,850

[22] Filed: Oct. 18, 1982

[51] Int. Cl.[3] ..... B65D 90/04

[52] U.S. Cl. ..... 220/404; 220/1 T; 248/100

[58] Field of Search ..... 248/95, 99, 100; 220/1 T, 404, 403, 461

[56] References Cited

U.S. PATENT DOCUMENTS

| | | | |
|---|---|---|---|
| 3,130,853 | 4/1964 | Colthurst et al. | 220/404 |
| 3,313,504 | 4/1967 | Stoltze | 248/99 |
| 3,391,698 | 7/1968 | Wiles | 248/99 X |
| 3,402,848 | 9/1968 | Busey | 220/1 T X |
| 4,316,353 | 2/1982 | Suominen | 248/100 X |
| 4,332,361 | 6/1982 | McClellan | 248/99 X |

FOREIGN PATENT DOCUMENTS

| | | | |
|---|---|---|---|
| 120020 | 10/1970 | Norway | 248/100 |

*Primary Examiner*—Allan N. Shoap
*Assistant Examiner*—Robert Petrik
*Attorney, Agent, or Firm*—Klaas & Law

[57] ABSTRACT

An improved trash container apparatus for mounting a plastic grocery bag therein for use as a trash container liner is described. Brackets for mounting a plastic grocery bag with the trash container and design and attachment thereof are described.

2 Claims, 5 Drawing Figures

FIG. 3
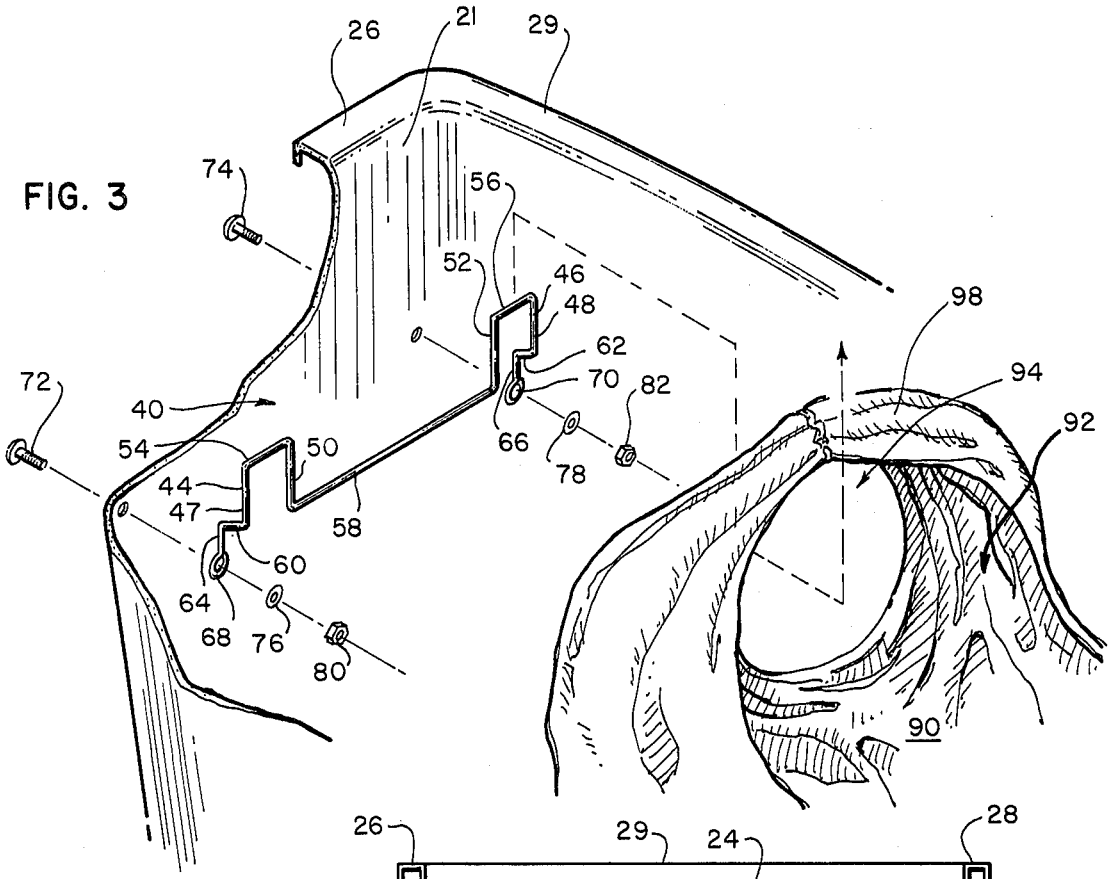
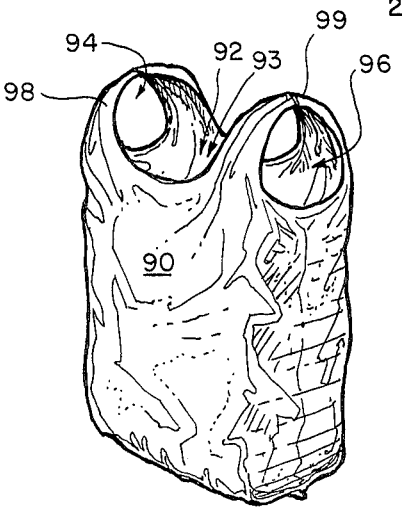
FIG. 4
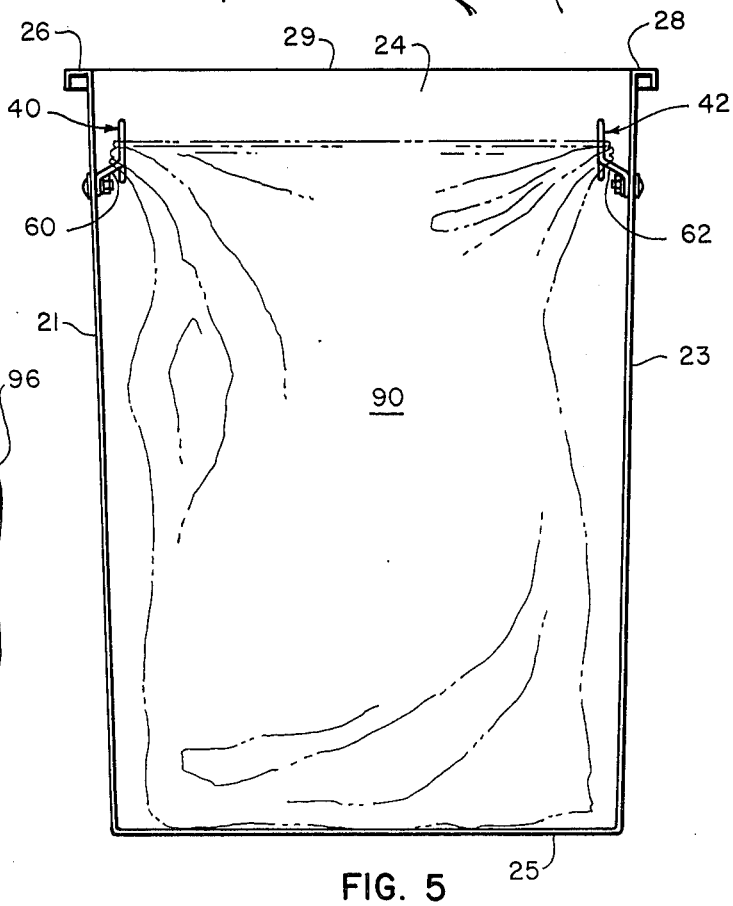
FIG. 5

TRASH CONTAINER APPARATUS

BACKGROUND OF THE INVENTION

The present invention relates generally to household trash container apparatus and more particularly to household trash container apparatus having a removable inner lining.

The use of household trash containers for temporarily containing trash and the like and the use of removable lining materials for keeping the interior of the outer trash container relatively clean and sanitary is well known in the art. One type of trash container lining in widespread use is an oversized plastic bag member that may be placed within the cavity of the trash container. Plastic liners of this type are generally of sufficient length to allow the outer peripheral edge of the liner to be folded back over the outer periphery of the trash receptacle for the purpose of providing vertical support to the walls of the liner and thereby preventing the liner from slipping down into the container cavity. Another commonly used liner for trash containers is a paper grocery bag of a size approximating the size of the trash container cavity. Although a paper grocery bag is generally of insufficient length to be folded back over the upper edges of a conventionally sized kitchen trash container, the structural rigidity of the paper is generally sufficient to maintain the paper bag in an upright position within the inner cavity. The outer walls of the trash container in both cases provides lateral support for the inner liner preventing rupture and tearing thereof from various stress forces generated by the weight of the material therein. The advantage of the plastic liners over the paper bags has been that plastic liners are generally stronger and impervious to fluids and may thus be removed from the household trash container and carried directly to an outdoor trash receptacle without tearing or rupture. The advantage of paper grocery bags has been that they are generally free recycleable material which may be used at no cost to the homeowner.

It has recently become a custom of many grocery store chains to switch from paper grocery bags to plastic grocery bags of approximately the same size as the paper bags being replaced. The new plastic grocery bags have two cutout portions in the lateral sides of the bag in addition to the opening at the top of the bag which provide two carrying straps which may be placed together and held by one hand to enable easy transportation of the groceries contained in the bag. However, prior to the present invention, the plastic grocery bags were unusable as trash container liners since plastic material does not have sufficient structural integrity to maintain the plastic bag in an upright position within the container and the plastic grocery bags do not have sufficient length to allow folding over the upper edge of the trash receptacle.

A need exists for a trash container capable of supporting a plastic grocery bag or the like therein. A further need exists for an apparatus which may be retrofit on existing trash containers for the purpose of adapting them for use with plastic grocery bags and the like.

SUMMARY OF THE INVENTION

The present invention comprises bracket means which may be positioned within a conventional trash container to form an improved trash contained apparatus capable of supporting plastic grocery bags in an upright position stretched open at the upper surface thereof to allow convenient insertion of materials to be disposed of therein. The bracket means may comprise two separate bracket members which may be positioned on opposed walls of a conventional trash container having an internal cavity of substantially the same volume as a plastic trash bag. The brackets may be mounted near the upper opening of the trash container and comprise means for holding the upper edge surface of the plastic bag in a spaced apart configuration substantially parallel and in close relationship to the walls of the trash container. Each bracket means may comprise spaced apart vertical edge surfaces thereon having the function of receiving encompassing edges of the handle strap portion of the plastic grocery bag whereby material in the area surrounding the handle portion is held in stretchingly deformed tension. The spacing between the two bracket members is such that the material in the area around the main opening of the bag is held in stretchingly deformed tension between the two bracket members. The brackets may be provided with conventional attachment means to provide easy attachment to the walls of the trash container and may also be provided with spacing means between the attachment means and the spaced apart vertical portions of each bracket to provide proper bracket spacing for stretching the plastic bag at its upper opening and also for the purpose of providing vertical support to the bag at the handle strap portions thereof.

BRIEF DESCRIPTION OF THE DRAWINGS

An illustrative and presently preferred embodiment of the invention is shown in the accompanying drawing in which:

FIG. 3 is an exploded cutaway view of a portion of an improved trash container apparatus.

FIG. 4 is a perspective view of a plastic grocery bag of the type used in improved trash container apparatus FIGS. 1, 2, and 3.

FIG. 5 is a cutaway side view of an improved trash container apparatus.

DETAILED DESCRIPTION OF THE INVENTION

Figure 1:
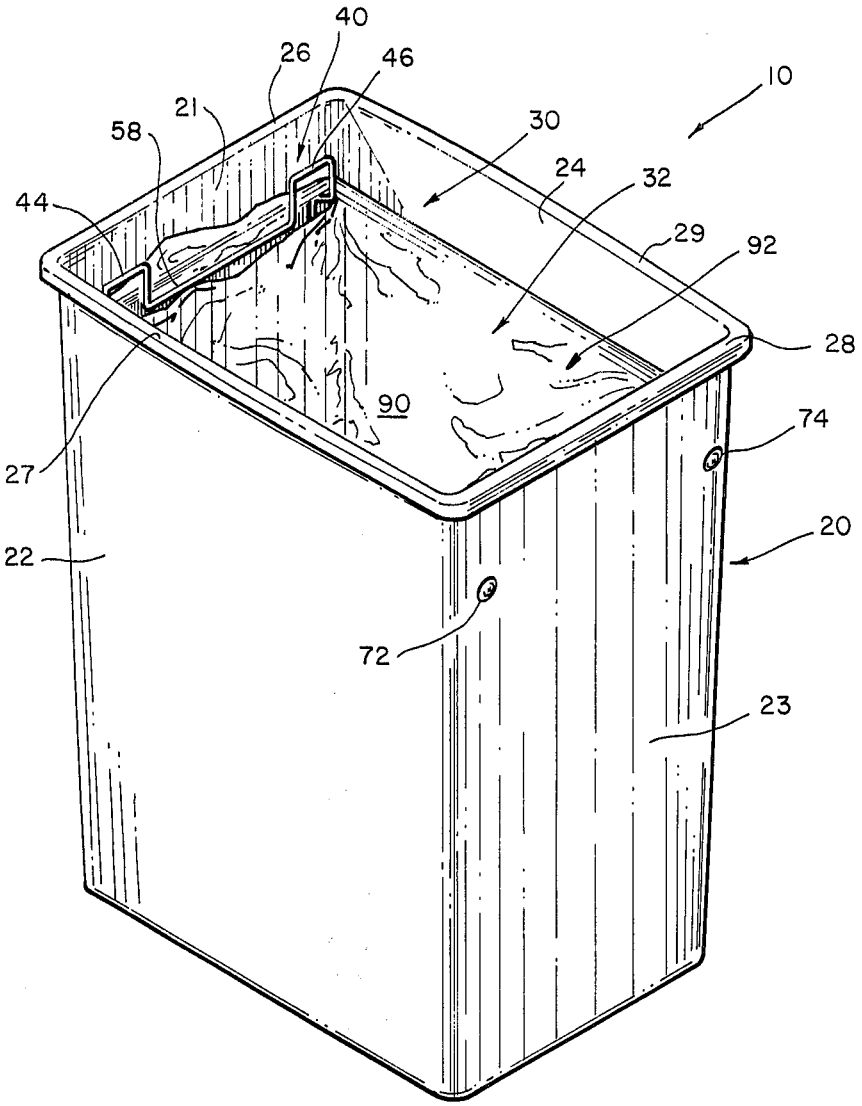
FIG. 1 is a perspective view of an improved trash container apparatus.

As illustrated by FIG. 1 the improved trash container apparatus 10 of the present invention comprises an outer container means 20 which in one preferred embodiment comprises four generally trapezoidal side walls, 21–24, sealingly connected to a horizontal bottom wall 25, FIG. 5, having a generally rectangular configuration. The container walls comprise intersecting upper edge surfaces 26–29, which lie substantially within a horizontal plane parallel to bottom wall 25 and which define a generally rectangular mouth 30 providing access to the container cavity 32 defined by said walls 21–25 and the plane of said upper edge surfaces 26 through 29. As illustrated in FIGS. 1–3 and 5, bracket means are provided near the upper edges 26, 28 of two opposed container walls 21, 23 and in one preferred embodiment comprise bracket members 40, 42 each formed from a single length of elongate cylindrical material such as heavy gauge wire, preformed plastic or the like which may have a diameter of approximately 1/16th inch to $\frac{1}{4}$ inch. Each bracket has two spaced apart generally vertically oriented outer vertical sections 47, 48 thereon. The lower edge of each outer vertical section 47, 48 is integrally formed with a generally horizontally extending spacer member 60, 62, FIGS. 3 and 5, extending generally horizontally outwardly therefrom, and in one embodiment downwardly inclined, and contacting a wall of said container upon which said bracket is mounted. Each spacer section 60, 62 in turn is integrally formed with a downwardly extending attachment section 64, 66 providing attachment of the bracket member 40, 42 to the associated side wall 21, 23 in a manner which provides an abuting relationship between the end of the spacer section 60, 62 and the container wall. The spacer section 60, 62 performs the double function of providing a vertical support to a strap section 98, 99 of a plastic grocery bag, as discussed in further detail hereinafter, while simultaneously providing the proper distance between the bracket members 40, 42 to insure proper positioning of a plastic container 90 within the outer container means cavity 32. In one preferred embodiment of the bracket means, each bracket member 40, 42 comprises two spaced apart ear portions 44, 46, each ear portion comprising an aforementioned outer vertical section 47, 48 and an inner vertical section 50, 52. Each ear portion 44, 46 also comprises a horizontal connecting portion 54, 56 positioned between associated inner and outer vertical sections. Each bracket member 40, 42 also comprises a horizontal ear connecting portion 58 integrally formed with the lower end of each inner vertical section 50, 52, the two spaced apart ear portions 44, 46 and horizontal ear connector portions 58 lying substantially within a plane positioned perpendicular to the bottom wall 25 and parallel an associated attachment wall 21, 23. The bracket members 40, 42 may be attached to associated walls by conventional attachment means such as bracket eyelet portions 68, 66 and bolts 72, 74 having washers 76, 78 and nuts 80, 82 threadably acceptable thereon.

Figure 2:
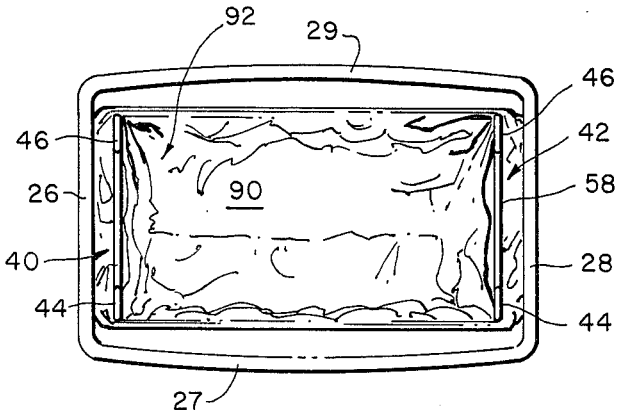
FIG. 2 is a plan view of an improved trash container apparatus.

As illustrated in FIG. 4 a plastic bag means 90 to be positioned within the outer container means 20 may comprise a conventional plastic grocery bag formed from a plastic film material. The bag 90 has an insertion opening 92 for inserting material to be disposed of into an internal cavity 93 defined by the interior surface of the bag. The bag also comprises first and second handle openings 94, 96 positioned in spaced apart opposed relationship on the lateral surface of the bag 90. The insertion opening 92 and first and second handle openings 94, 96 define first and second bag strap portions 98, 99 positioned at either end of the insertion opening 92. The strap portions 98, 99 may be placed in encompassing relationship over associated bracket members 40, 42 as illustrated in FIGS. 1, 2 and 5. The spacing of the outer vertical sections 47, 48 of the ear members 44, 46 of each bracket is such that the material surrounding each handle opening 94, 96 is slightly stretched as the associated strap portion is positioned about the bracket. The spacing between brackets 40, 42 is such that the material about the periphery of the insertion opening 92 is also stretched by the attachment of the straps 98, 99 to the associated brackets 40, 42. Thus, the plastic bag 90 is positioned with the insertion opening 92 in stretched apart taught relationship in a configuration generally parallel to the inside surfaces of adjacent associated walls 21, 22, 23, 24. The brackets 40, 42 are positioned at a height within the container means 20 whereby the plastic bag 90 extends in touching or near touching relationship with the outer container bottom 25. Thus the plastic bag means 90 is supported within the container means 20 in a manner which allows the plastic bag 90 to be completely filled with material to be disposed of. The bag 90 may then be easily removed from the brackets 40, 42 for disposal in an outdoor container or the like.

In one preferred embodiment of the invention, bracket ear outer and inner vertical sections 47, 48, 50, 52 each have a length of approximately 1.5 inches; each horizontal sections 54, 56 each have a length of approximately 1.3 inches; horizontal ear connecting portion 58 has a length of approximately 4.5 inches and spacer portion 60 has a length of approximately 0.5 inches. The spacing between brackets 40, 42 is approximately 12 inches. The height of the mounting point of each bracket 40, 42 above bottom wall 25 is approximately 14 inches.

It is contemplated that the inventive concepts herein described may be variously otherwise embodied and it is intended that the appended claims be construed to include alternative embodiments of the invention except insofar as limited by the prior art.

What is claimed is:

1. An improved trash container apparatus comprising:

(a) outer container means for structurally supporting and enclosing other container elements positioned therein, said outer container means comprising a generally rectangular bottom wall, positioned substantially in a horizontal plane, first, second, third and fourth generally trapezoidal side walls integrally formed therewith, said first wall being opposite said third wall, said second wall being opposite said fourth wall, said sidewalls having intersecting upper edge surfaces positioned substantially in a plane parallel to said bottom wall, said four intersecting upper edge surface forming a substantially rectangular figure having an area greater than said bottom wall defining a planar mouth of said outer container means, said walls and said planar mouth defining an outer container means cavity;

(b) flexible plastic inner container means operably positioned within said outer container means cavity for receiving material to be disposed of therein, said flexible plastic inner container means being formed from a flexible extensible plastic film material constructed and arranged to form a deformable enclosing envelope having an envelope cavity, said envelope comprising insertion opening means therein for inserting material to be disposed of into said enclosing envelope cavity and comprising handle opening means therein for removably mounting said flexible plastic inner container means on bracket means;

(c) first bracket means for removably supporting said flexible plastic inner container means within said outer container means cavity, comprising a single length of elongate cylindrical material having two spaced apart outer vertical portions, the lower end of each said outer vertical portion being integrally formed with a first end of an associated, transversely extending, spacer portion so that each said lower end is spaced from said outer container means; each spacer portion being integrally formed at a second end thereof with an associated downwardly extending attachment portion, each said attachment portion extending downwardly in abutting contact along the length thereof with said first wall of said outer container means, each said attachment portion having a circular configuration at a lower end thereof; each said outer vertical portion being integrally connected at the upper end thereof with a first end of an ear horizontally extending portion; each ear horizontally extending portion extending inwardly of an associated connected outer vertical portion in a direction substantially perpendicular said spacer portions; each said ear horizontally extending portion having a second end integrally connected to an upper end of an associated inner vertical portion; each inner vertical portion having a lower end integrally connected to opposite ends of an inner horizontally extending portion extending horizontally between said inner vertical portions in parallel relationship with said ear horizontal portions; said ear horizontally extending portions being of equal relatively small lengths and said inner horizontally extending portion being of a relatively large length; said outer vertical portions being spaced apart a sufficient distance whereby tension is produced in said flexible plastic inner container means about a handle opening when said handle opening is positioned in encompassing relationship about said outside vertical portions, said inner container means being vertically supported by said spacer portions, said spacer portions providing sufficient space between said first wall and said outer vertical portions for permitting grasping of a portion of said inner container stretched between said outer vertical portions, said inner horizontally extending portion being positioned at least as low as said spacer portion whereby said inner horizontally extending portion does not interfere with removal of said inner container portion;

(d) second bracket means having an identical size and configuration as said first bracket means attached to said third wall in mirror image relationship with said first bracket means;

(e) connector bolts for boltingly attaching said first and second bracket means to said outer container.

2. An improved trash container apparatus bracket assembly for mounting in a trash container of the type having a generally rectangular bottom wall, positioned substantially in a horizontal plane a first, second, third and fourth generally trapezoidal side walls integrally formed therewith, said first wall being opposite said third wall, said second wall being opposite said fourth wall, said sidewalls having intersecting upper edge surfaces positioned substantially in a plane parallel to said bottom wall, said four intersecting upper edge surfaces forming a substantially rectangular figure having an area greater than said bottom wall defining a planar mouth of said trash container with said walls and said planar mouth defining a trash container cavity; for the purpose of adapting said trash container for removably supporting a plastic grocery bag or the like of the type formed from a flexible extensible plastic film material constructed and arranged to form a deformable enclosing envelope having an envelope cavity, said envelope having insertion opening means therein for inserting materials to be disposed of into said enclosing envelope cavity; said bracket assembly comprising:

first bracket means for removably supporting the flexible plastic envelope within said outer container means cavity, comprising a single length of elongate cylindrical material having two spaced apart outer vertical portions, the lower end of each said outer vertical portion being integrally formed with a first end of an associated, transversely extending, spacer portion so that each said lower end is spaced from said trash container; each spacer portion being integrally formed at a second end thereof with an associated downwardly extending attachment portion, each said attachment portion extending downwardly in abutting contact along the length thereof with said first wall of said outer container means, each said attachment portion having a circular configuration at a lower end thereof; each said outer vertical portion being integrally connected at the upper end thereof with a first end of an ear horizontally extending portion; each ear horizontally extending portion extending inwardly of an associated connected outer vertical portion in a direction substantially perpendicular said spacer portions; each said ear horizontally extending portion having a second end integrally connected to an upper end of an associated inner vertical portion; each inner vertical portion having a lower end integrally connected to opposite ends of an inner horizontally extending portion extending horizontally between said inner vertical portions in parallel relationship with said ear horizontal portions; said ear horizontally extending portions being of equal relatively small lengths and said inner hoirzontally extending portion being of a relatively large length; said outer vertical portions being spaced apart a sufficient distance whereby tension is produced in said flexible plastic envelope about a handle opening when said handle opening is positioned in encompassing relationship about said outside vertical portions, said inner envelope being vertically supported by said spacer portions, said spacer portions providing sufficient space between said first wall and said outer vertical portions for permitting grasping of a portion of said inner container stretched between said outer vertical portions, said inner horizontally extending portion being positioned at least as low as said spacer portion whereby said inner horizontally extending portion does not interfere with removal of said inner container portion;

second bracket means having an identical size and configuration as said first bracket means attached to said third wall in mirror image relationship with said first bracket means;

connector bolts for boltingly attaching said first and second bracket means to said outer container.

* * * * *